US009701429B2

(12) United States Patent
Squarzoni

(10) Patent No.: US 9,701,429 B2
(45) Date of Patent: Jul. 11, 2017

(54) PACKING METHOD FOR PRODUCING A HINGED-LID, SLIDE-OPEN PACKAGE OF TOBACCO ARTICLES WITH A SEALING FLAP

(71) Applicant: G.D SOCIETA' PER AZIONI, Bologna (IT)

(72) Inventor: Michele Squarzoni, Ferrara (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 578 days.

(21) Appl. No.: 14/356,399

(22) PCT Filed: Nov. 7, 2012

(86) PCT No.: PCT/IB2012/056242

§ 371 (c)(1),
(2) Date: May 6, 2014

(87) PCT Pub. No.: WO2013/068951

PCT Pub. Date: May 16, 2013

(65) Prior Publication Data

US 2014/0305080 A1 Oct. 16, 2014

(30) Foreign Application Priority Data

Nov. 7, 2011 (IT) ..... BO2011A0632

(51) Int. Cl.
*B65B 11/00* (2006.01)
*B65B 11/58* (2006.01)
(Continued)

(52) U.S. Cl.
CPC ..... *B65B 19/02* (2013.01); *B65B 11/004* (2013.01); *B65B 11/58* (2013.01); *B65B 19/22* (2013.01)

(58) Field of Classification Search
CPC .. B65B 7/22; B65B 7/26; B65B 11/58; B65B 19/18; B65B 19/20; B65B 43/41;
(Continued)

(56) References Cited

U.S. PATENT DOCUMENTS 2,159,158 A * 5/1939 Horgan ..... B65B 19/22 53/169
2,340,835 A * 2/1944 Malhiot ..... B65B 7/22 493/178
(Continued)

FOREIGN PATENT DOCUMENTS

CA 2738443 A1 4/2010
CA 2754987 A1 9/2010
(Continued)

OTHER PUBLICATIONS

International Search Report for International Patent Application No. PCT/IB2012/056242, dated Mar. 15, 2013.

*Primary Examiner* — Thanh Truong
*Assistant Examiner* — Patrick Fry
(74) *Attorney, Agent, or Firm* — Marshall, Gerstein & Borun LLP

(57) ABSTRACT

A packing method for producing a package of tobacco articles having: an inner container, which houses a group of tobacco articles, and has an open top end and a hinged lid to close the open top end; an outer container housing the inner container so as to allow the inner container to slide with respect to the outer container between a closed configuration and an open configuration; and a sealing flap, which is hinged to a top edge of a front wall of the outer container, and is movable between a work position, in which the sealing flap is perpendicular to the front wall of the outer container and located beneath a top wall of the lid of the inner container, and a rest position, in which the sealing flap
(Continued)

is substantially parallel to the front wall of the outer container.

10 Claims, 10 Drawing Sheets

(51) Int. Cl.
*B65B 19/02* (2006.01)
*B65B 19/22* (2006.01)

(58) Field of Classification Search
CPC ..... B65B 2230/04; B65D 5/38; B65D 7/10; B65D 9/08; B65D 85/1045
USPC ..... 53/169, 449
See application file for complete search history.

(56) References Cited

U.S. PATENT DOCUMENTS 2,470,270 A * 5/1949 Srofe ..... B65D 5/38 206/425
2,929,542 A * 3/1960 O'Gorman ..... B65D 5/6688 206/268
4,112,651 A * 9/1978 Bardenhagen ..... B65B 19/20 53/170
6,708,466 B2 * 3/2004 Spatafora ..... B65B 19/225 53/173
7,604,117 B2 * 10/2009 Bourgoin ..... B65D 5/38 206/267
8,245,841 B2 * 8/2012 Agirbas ..... B65D 5/38 206/268
8,745,962 B2 * 6/2014 Squarzoni ..... B65B 19/223 53/170
9,211,996 B2 * 12/2015 Petrucci ..... B65D 85/1054
9,254,938 B2 * 2/2016 Iwata ..... B65D 5/662
2008/0128301 A1 6/2008 Bourgoin et al.
2011/0062175 A1 * 3/2011 Nakamura ..... B65D 85/1054 220/810
2014/0305082 A1 * 10/2014 Alessandri ..... B65B 19/22 53/463
2014/0305084 A1 * 10/2014 Lanzarini ..... B65B 19/20 53/484
2015/0336696 A1 * 11/2015 Cavazza ..... B65B 19/20 53/456
2015/0336697 A1 * 11/2015 Cavazza ..... B65B 19/20 53/456

FOREIGN PATENT DOCUMENTS

CN 200992370 Y 12/2007
CN 101535134 A 9/2009
CN 102209668 A 10/2011
EP 1 927 548 A1 6/2008
EP 2 325 093 A1 5/2011
WO WO-2010/102702 A1 9/2010

* cited by examiner

PACKING METHOD FOR PRODUCING A HINGED-LID, SLIDE-OPEN PACKAGE OF TOBACCO ARTICLES WITH A SEALING FLAP

CROSS-REFERENCE TO RELATED APPLICATIONS

This is the U.S. national phase of International Application No. PCT/IB2012/056242, filed Nov. 7, 2012, which claims the benefit of Italian Patent Application No. BO2011A000632, filed Nov. 7, 2011.

TECHNICAL FIELD

The present invention relates to a packing method for producing a hinged-lid, slide-open package of tobacco articles.

In the following description, reference is made, for the sake of simplicity and purely by way of example, to a hinged-lid, slide-open packet of cigarettes.

BACKGROUND ART

Rigid, hinged-lid packets of cigarettes are currently the most widely marketed, by being easy to produce and easy and practical to use, and by effectively protecting the cigarettes inside.

In addition to the above rigid, hinged-lid packets of cigarettes, rigid slide-open packets have been proposed comprising two partly separable containers, one inserted inside the other. In other words, a rigid, slide-open packet of cigarettes comprises an inner container, which houses a foil-wrapped group of cigarettes and is housed inside an outer container to slide, with respect to the outer container, between a closed configuration, in which the inner container is inserted inside the outer container, and an open configuration, in which the inner container is partly extracted from the outer container.

A rigid, hinged-lid, slide-open packet of cigarettes has also been proposed in which the inner container has a hinged lid, which rotates between a closed position and an open position closing and opening an open top end of the inner container. The inner container lid has a connecting tab connected at one end to the lid, and at the other end to the outer container, to 'automatically' rotate the lid (i.e. without the user having to touch the lid) as the inner container slides with respect to the outer container.

However, when turned upside down (as often happens inside the user's bag or pocket), rigid, hinged-lid, slide-open packets of cigarettes tend to spill tobacco powder (or flecks), which substantially escape through the gap between the front edge of the top wall of the inner container lid and the opposite top edge of the front wall of the outer container. To prevent tobacco powder spill, it has been proposed to add a sealing flap connected (hinged) to the top edge of the front wall of the outer container and movable between a work position (assumed in the closed position, i.e. when the inner container is inserted fully inside the outer container) and a rest position (assumed in the open position, i.e. when the inner container is extracted partly from the outer container). In the work position, the sealing flap is perpendicular to the front wall of the outer container and located beneath the top wall of the inner container lid to prevent tobacco powder spill by 'sealing' the gap between the front edge of the top wall of the inner container lid and the opposite top edge of the front wall of the outer container. In the rest position, the sealing flap is substantially parallel to, i.e. substantially coplanar with, the front wall of the outer container, to avoid interfering with the movement of the inner container with respect to the outer container.

A rigid, hinged-lid, slide-open packet of cigarettes is produced using a first blank, which is folded about the group of cigarettes on a first packing unit to form the inner container; and a second blank, which is folded about the inner container on a second packing unit to form the outer container. At present, it is proposed to fold the sealing flap into its final position when folding the second blank about the inner container, but so doing has been found to result in serious mechanical complications of the folding devices involved.

DESCRIPTION OF THE INVENTION

It is an object of the present invention to provide a packing method for producing a hinged-lid, slide-open package of tobacco articles with a sealing flap, designed to eliminate the above drawbacks, and which is cheap and easy to implement.

According to the present invention, there is provided a packing method for producing a hinged-lid, slide-open package of tobacco articles with a sealing flap, as claimed in the accompanying Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
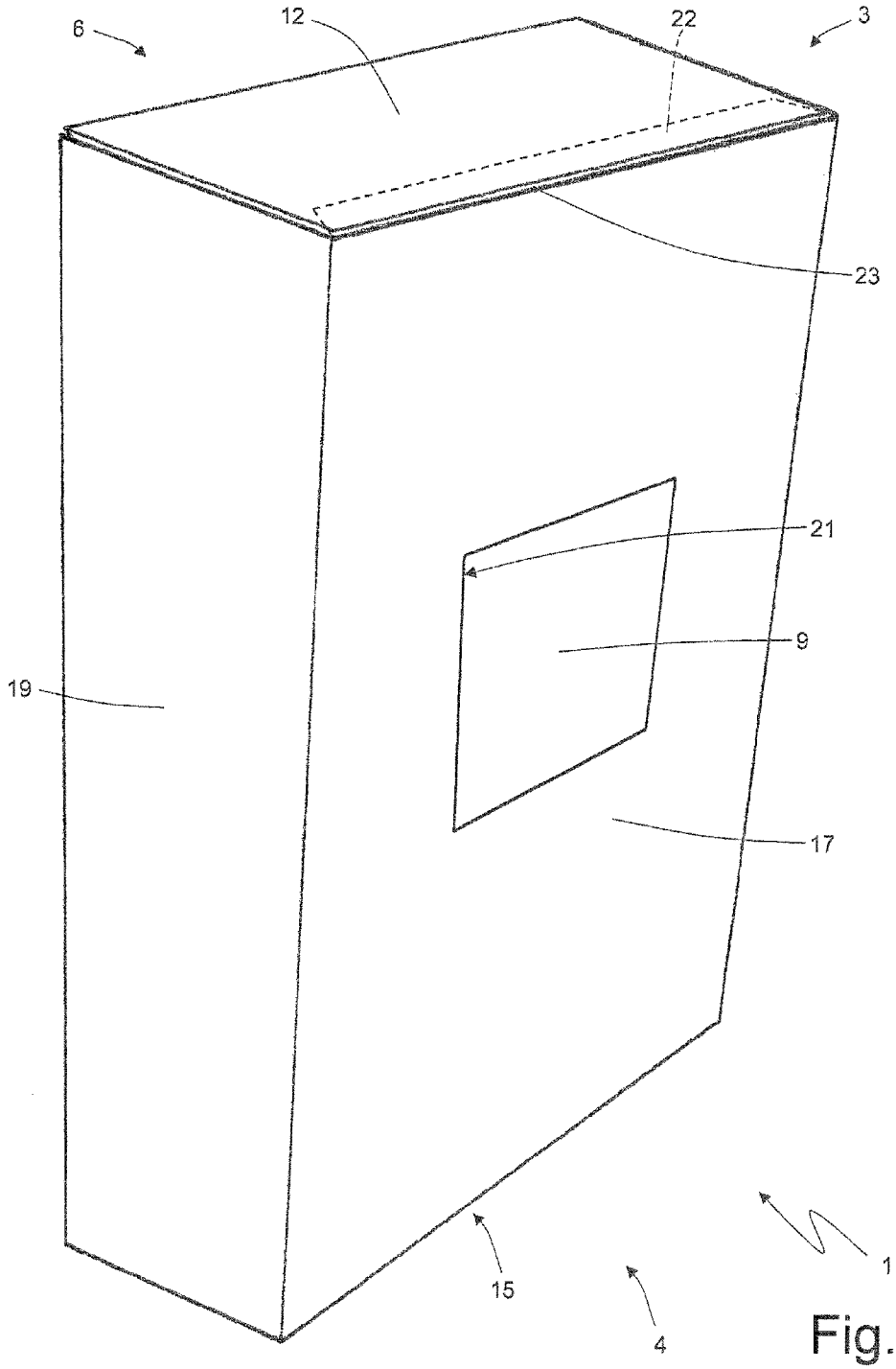
FIG. 1 shows a front view in perspective of a rigid, hinged-lid, slide-open packet of cigarettes with a sealing flap, in accordance with the present invention and in a closed configuration.
Figure 2:
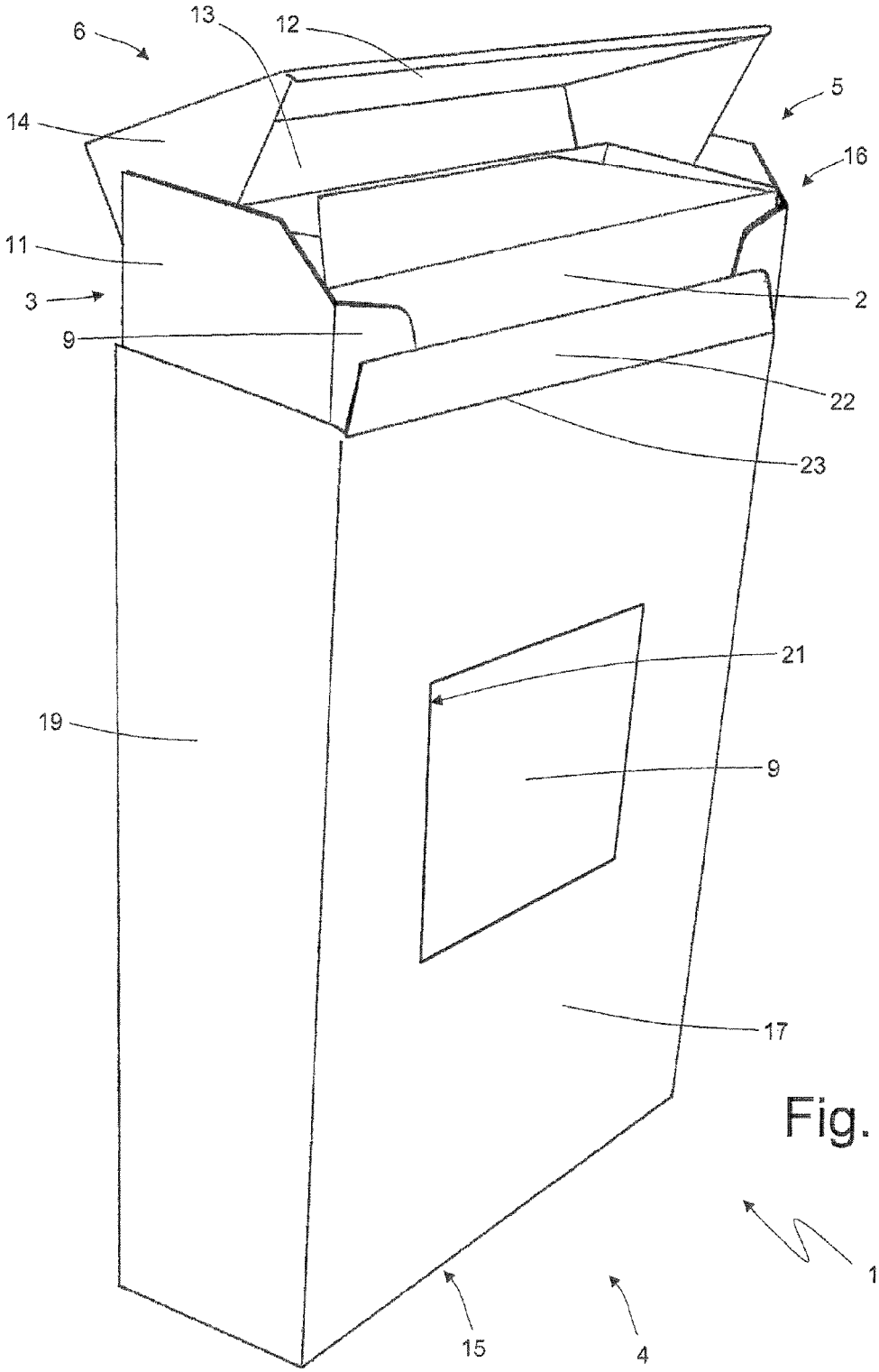
FIG. 2 shows a front view in perspective of the FIG. 1 packet of cigarettes in an open configuration.
Figure 3:
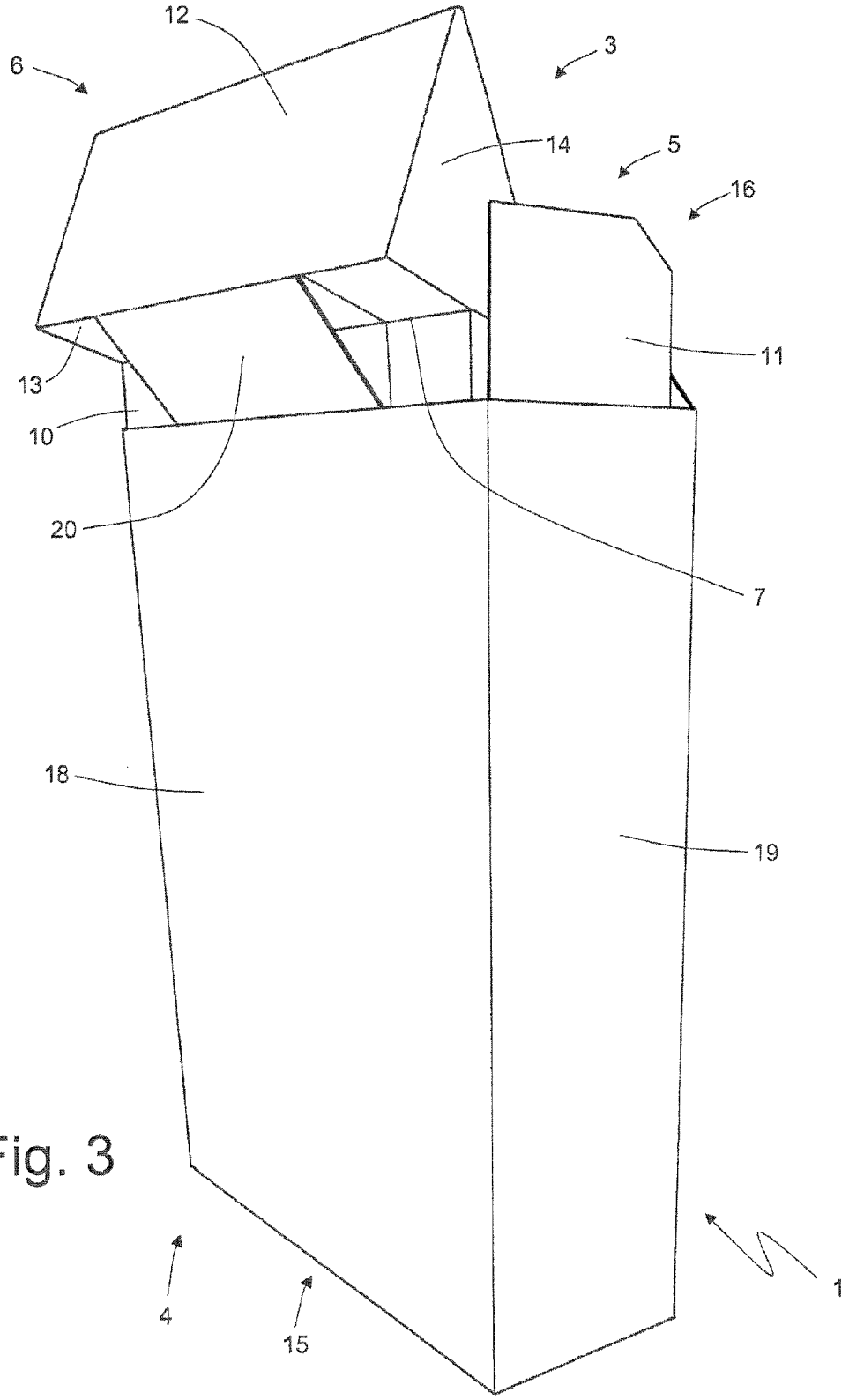
FIG. 3 shows a rear view in perspective of the FIG. 1 packet of cigarettes in an open configuration.
Figure 4:
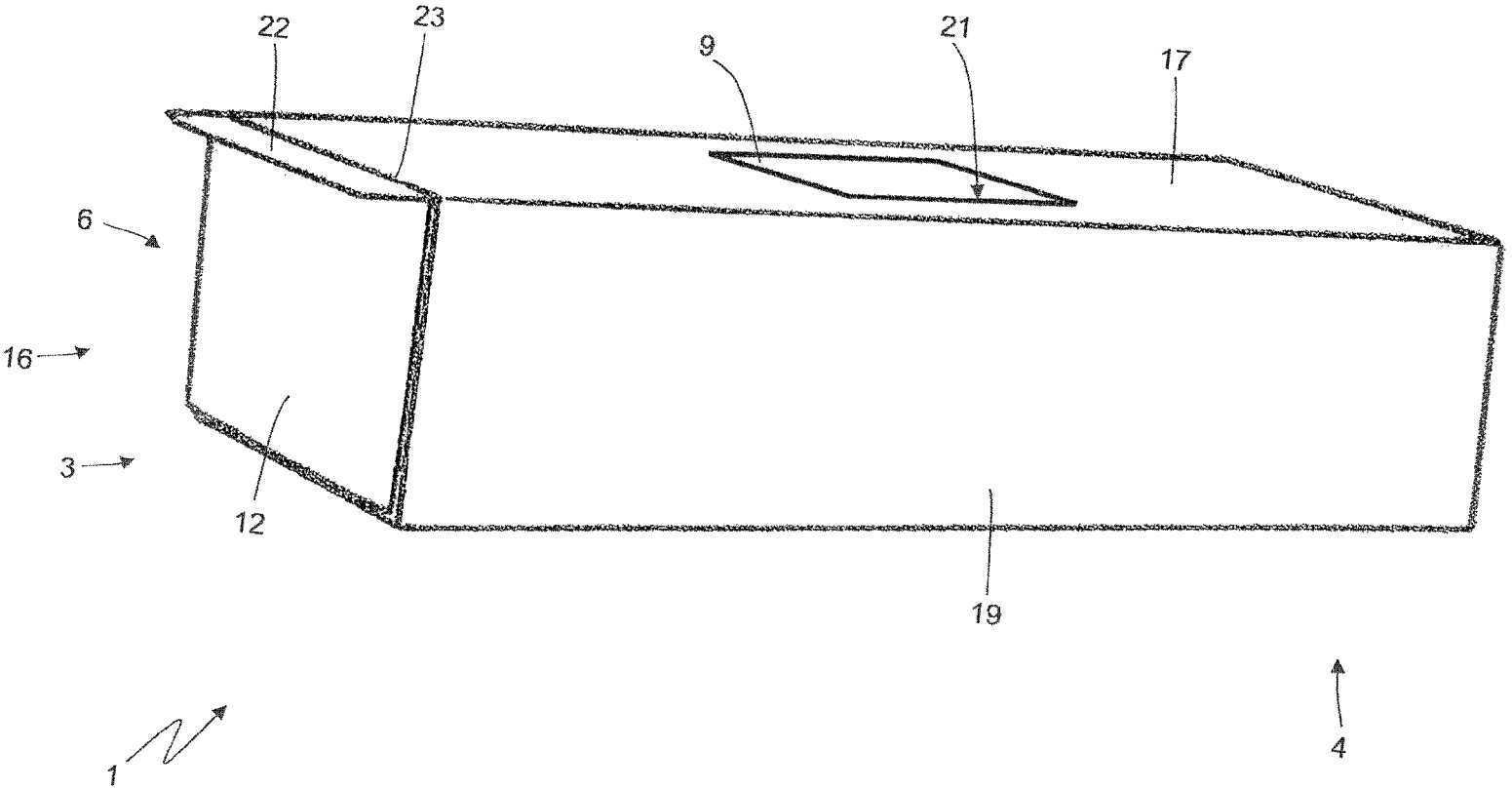
FIGS. 4 to 8 show the folding sequence of a sealing flap of the FIG. 1 packet of cigarettes.

Number 1 in FIGS. 1, 2 and 3 indicates as a whole a rigid, slide-open packet of cigarettes, which opens in a translatory (linear) movement.

The FIG. 1 packet 1 of cigarettes comprises a wrapped, i.e. foil-wrapped group 2 of cigarettes (shown schematically in FIG. 2). Packet 1 of cigarettes also comprises a rigid inner container 3 actually containing the wrapped group 2 of cigarettes; and a rigid outer container 4, which houses inner container 3 to allow inner container 3 to slide in a translatory movement, with respect to outer container 4, between a closed configuration (FIG. 1), in which inner container 3 is inserted fully inside outer container 4, and an open configuration (FIGS. 2 and 3), in which inner container is partly extracted from outer container 4 to allow access to wrapped group 2 of cigarettes.

Inner container 3 is parallelepiped-shaped with a rectangular cross section, is cup-shaped, and comprises an open top end 5. Inner container 3 comprises a cup-shaped lid 6 hinged to inner container 3 along a hinge 7 to rotate, with respect to inner container 3, between an open position (FIGS. 2 and 3) and a closed position (FIG. 1) opening and closing open top end 5 respectively.

Inner container 3 comprises a bottom wall (not shown) opposite open top end 5; a front wall 9 and rear wall 10 opposite and parallel to each other; and two parallel lateral walls 11 interposed between walls 9 and 10.

Lid 6 is cup-shaped, and comprises a top wall 12 (which is parallel to and opposite the bottom wall of inner container 3 when lid 6 is closed); a rear wall 13 connected to rear wall 10 of inner container 3 by hinge 7; and two parallel lateral walls 14.

Outer container 4 is cup-shaped, is parallelepiped-shaped with a rectangular cross section, and comprises a bottom wall 15 opposite an open top end 16; a front wall 17 and rear wall 18 opposite and parallel to each other; and two parallel lateral walls 19 interposed between walls 17 and 18.

As shown in FIG. 3, rear wall 13 (more specifically, a top edge of rear wall 13) of lid 6 is connected to rear wall 18 of outer container 4 by a connecting tab 20 to rotate lid 6 'automatically' (i.e. without the user having to touch lid 6) as inner container 3 slides with respect to outer container 4. In other words, by means of connecting tab 20 connecting rear wall 13 of lid 6 mechanically to rear wall 18 of outer container 4, inner container 3, as it slides with respect to outer container 4 from the closed to the open configuration, pushes lid 6 from the closed to the open position 'automatically' (i.e. without the user having to touch lid 6); and similarly, as inner container 3 slides with respect to outer container 4 from the open to the closed configuration, lid 6 is pushed by inner container from the open to the closed position 'automatically' (i.e. without the user having to touch lid 6). The user therefore need simply exert sufficient thrust to slide inner container 3 with respect to outer container 4, without having to touch lid 6, which is rotated 'automatically'.

In the embodiment shown in the drawings, front wall 17 of outer container 4 has a through opening 21 allowing access to front wall 9 of inner container 3 to exert thrust on inner container 3 to move it between the closed and open configurations. In a different, equivalent embodiment, through opening 21 is formed astride front wall 17 and a lateral wall 19 of outer container 4, or in bottom wall 15 of outer container 4.

As shown in FIGS. 1 and 2, outer container 4 comprises a sealing flap 22 for preventing tobacco powder spill through the gap between the front edge of top wall 12 of lid 6 of inner container 3 and the corresponding top edge of front wall 17 of outer container 4. Sealing flap 22 is hinged to the top edge of front wall 17 of outer container 4 along a transverse fold line 23, and is movable between a work position (shown in FIG. 1 and assumed in the closed configuration, i.e. when inner container 3 is fully inserted inside outer container 4), and a rest position (shown in FIG. 2 and assumed in the open configuration, i.e. when inner container 3 is extracted partly from outer container 4). In the work position; sealing flap 22 is perpendicular to front wall 17 of outer container 4 and located beneath top wall 12 of lid 6 of inner container 3, to prevent tobacco powder spill by 'sealing' the gap between the front edge of top wall 12 of lid 6 of inner container 3 and the opposite top edge of front wall 17 of outer container 4. In the rest position (as shown clearly in FIG. 2), sealing flap 22 is substantially parallel to, i.e. substantially coplanar with, front wall 17 of outer container 4, to avoid interfering with the movement of inner container 3 with respect to outer container 4.

Figure 9:
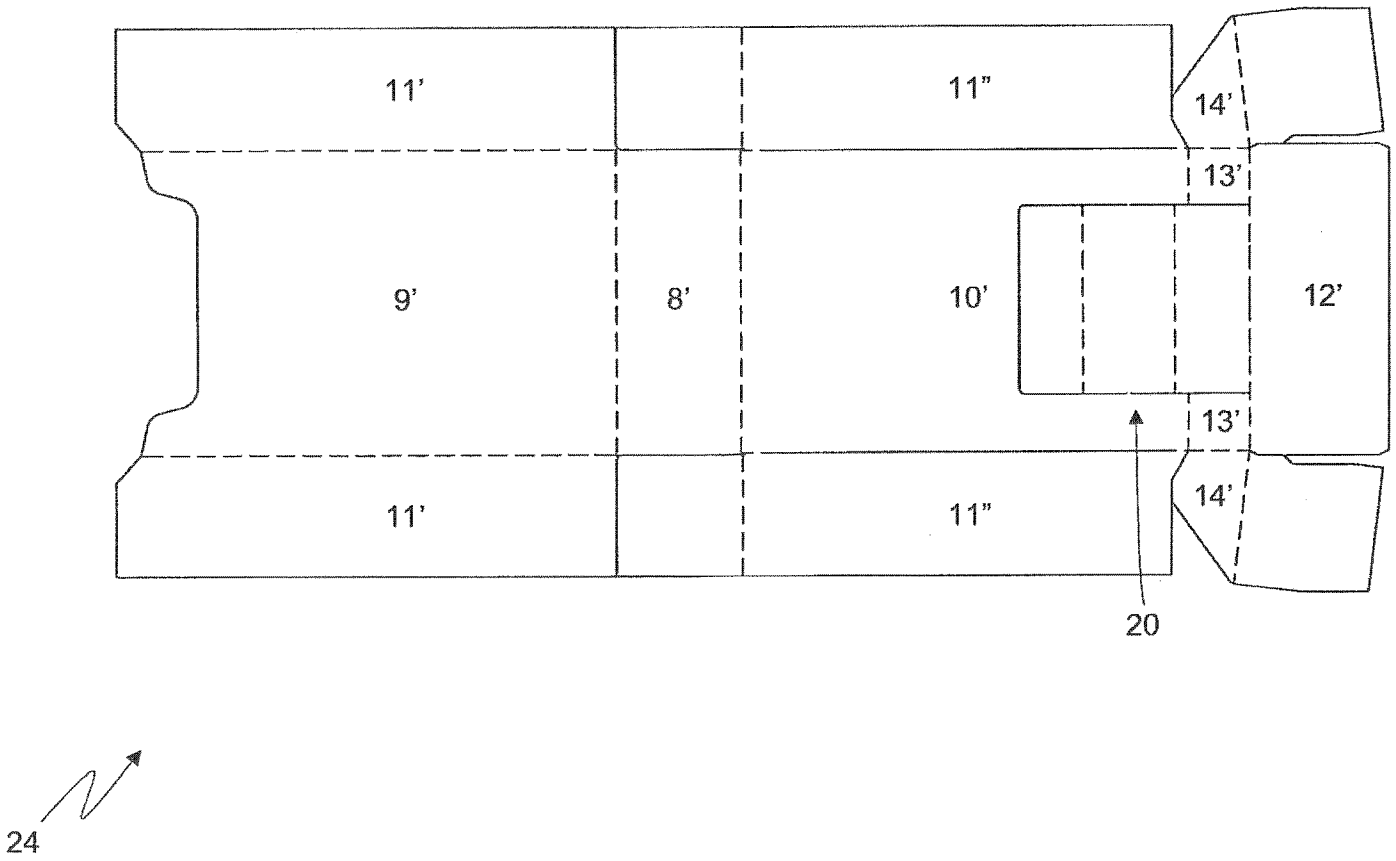
FIG. 9 shows a plan view of a blank from which to form an inner container of the FIG. 1 packet of cigarettes.
Figure 10:
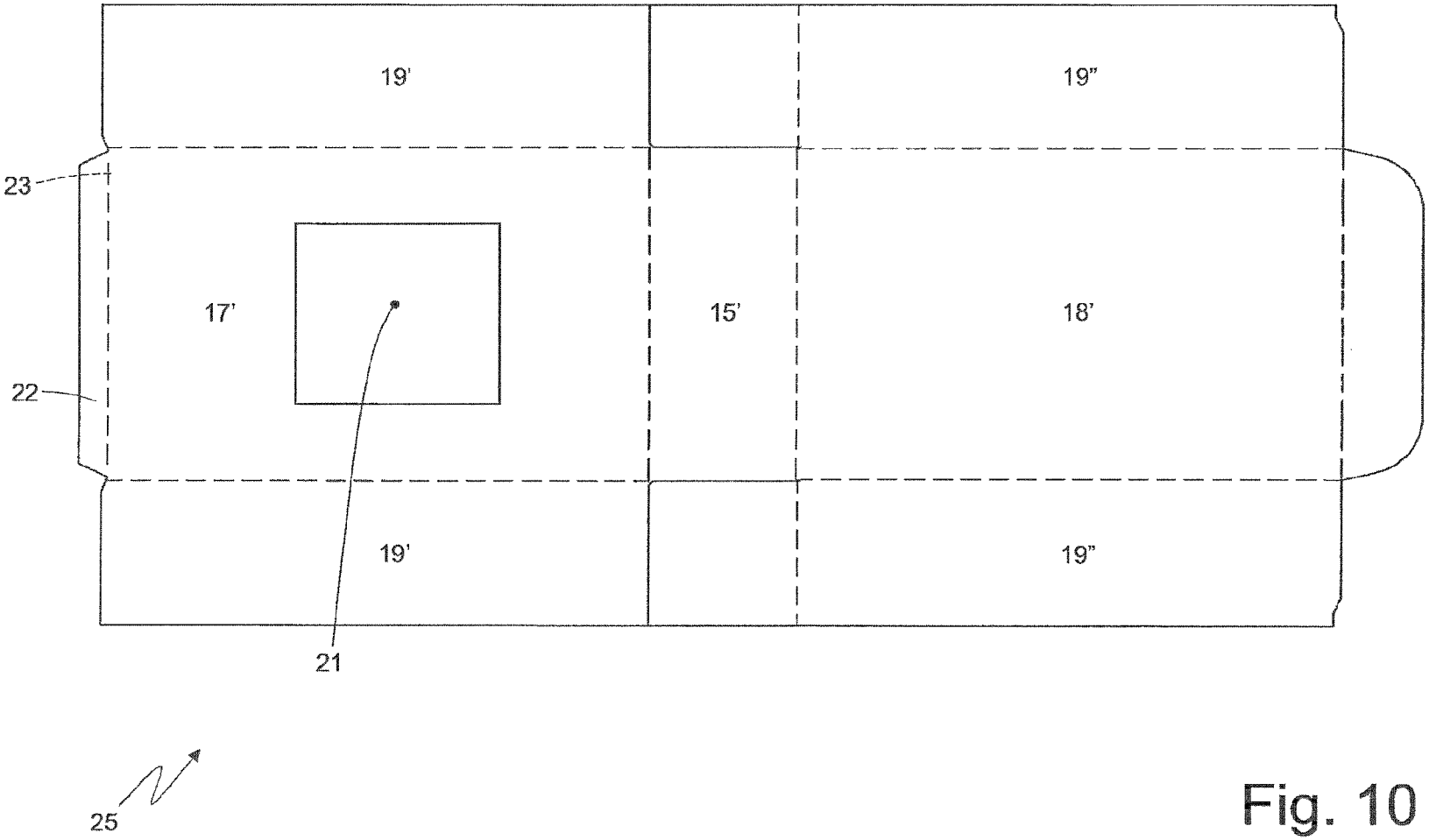
FIG. 10 shows a plan view of a blank from which to form an outer container of the FIG. 1 packet of cigarettes.

Containers 3 and 4 of packet 1 of cigarettes in FIGS. 1, 2 and 3 are formed from respective blanks 24 and 25 shown in FIGS. 9 and 10 respectively. Blanks 24 and 25 each comprise, among other things, a number of elements, which are indicated, where possible, using the same reference numbers, with superscripts, as for the corresponding walls of respective container 3, 4.

The way in which packet 1 of cigarettes described above is formed, and in particular the way in which sealing flap 22 is positioned as required, will now be described with reference to FIGS. 4-8.

Firstly, blank 24 is folded in known manner about wrapped group 2 of cigarettes to form inner container 3. Next, blank 25 is folded in known manner about inner container 3 to form outer container 4. As shown clearly in FIG. 4, when folding blank 25 about inner container 3, sealing flap 22 is not touched (folded) in any way, and is so left parallel to (coplanar with) front wall 17 of outer container 4, in the same position as in the flat blank 25 (i.e. before folding blank 25 about inner container 3). In other words, when folding blank 25 about inner container 3, sealing flap 22 is left unfolded in its original position coplanar with front wall 17 of outer container 4.

Figure 5:
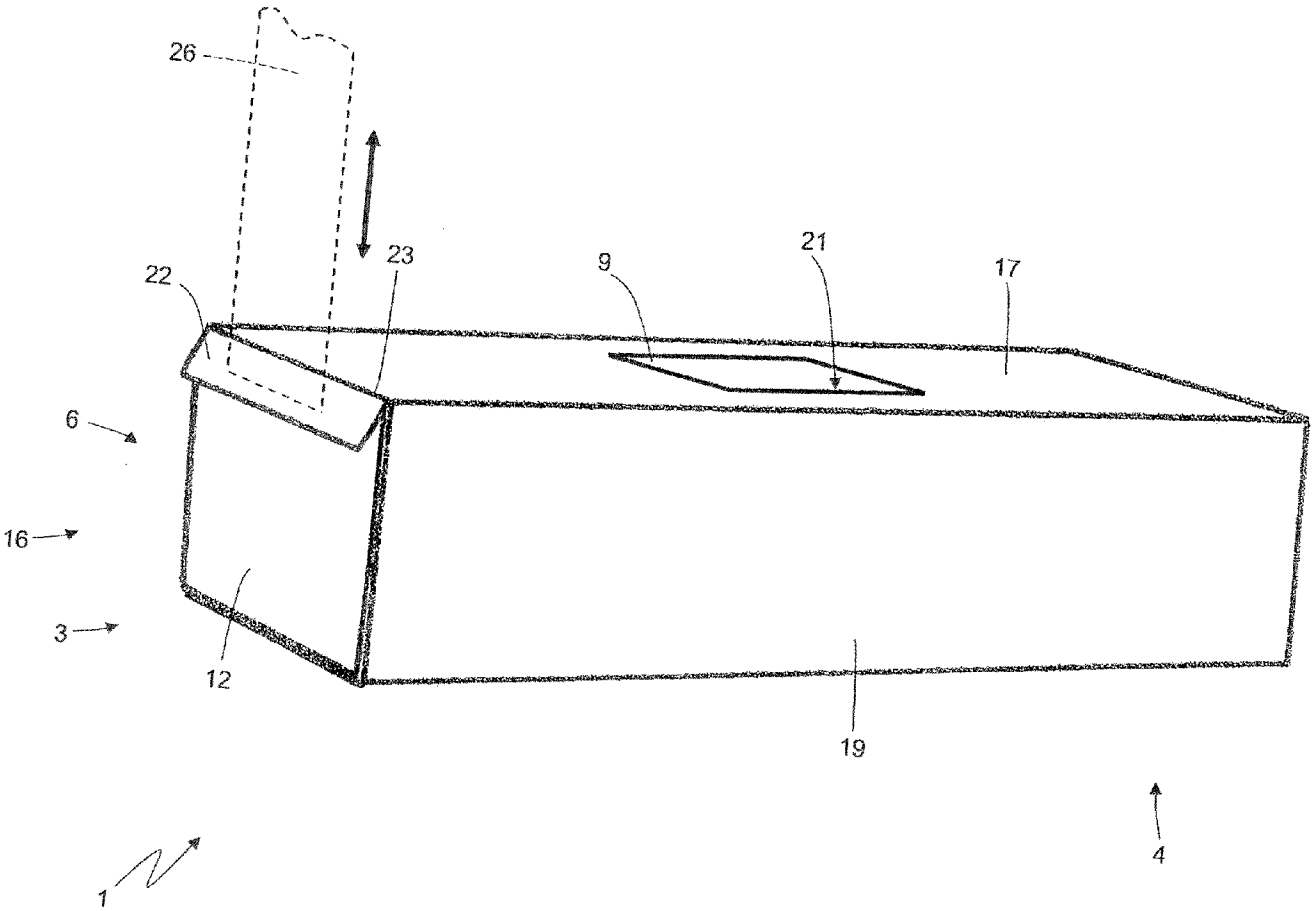

At this point (as shown in FIG. 5), sealing flap 22 is folded about transverse fold line 23 to 'weaken', i.e. permanently deform, the packing material along transverse fold line 23 and prevent sealing flap 22 from springing back to its original position coplanar with front wall 17 of outer container 4. In the FIG. 5 embodiment, sealing flap 22 is folded 90° about transverse fold line 23 onto top wall 12 of lid 6 of inner container 3 by a folding device 26, which moves in a straight line perpendicular to front wall 17 of outer container 4. In a different embodiment (not shown), folding device 26 rotates about an axis parallel to transverse fold line 23 and coplanar with top wall 12 of lid 6.

In a further embodiment (not shown), sealing flap 22 is folded about transverse fold line 23 towards front wall 17 of outer container 4. More specifically, sealing flap 22 is preferably folded 90° in the opposite direction, until it is perpendicular to front wall 17 of outer container 4, but on the opposite side to top wall 12 of lid 6.

In a further embodiment (not shown), sealing flap 22 is folded 180° about transverse fold line 23 onto front wall 17 of outer container 4. In these last two embodiments, sealing flap 22 is then preferably folded back (in known manner not shown) into its original position coplanar with front wall 17 of outer container 4.

Figure 6:
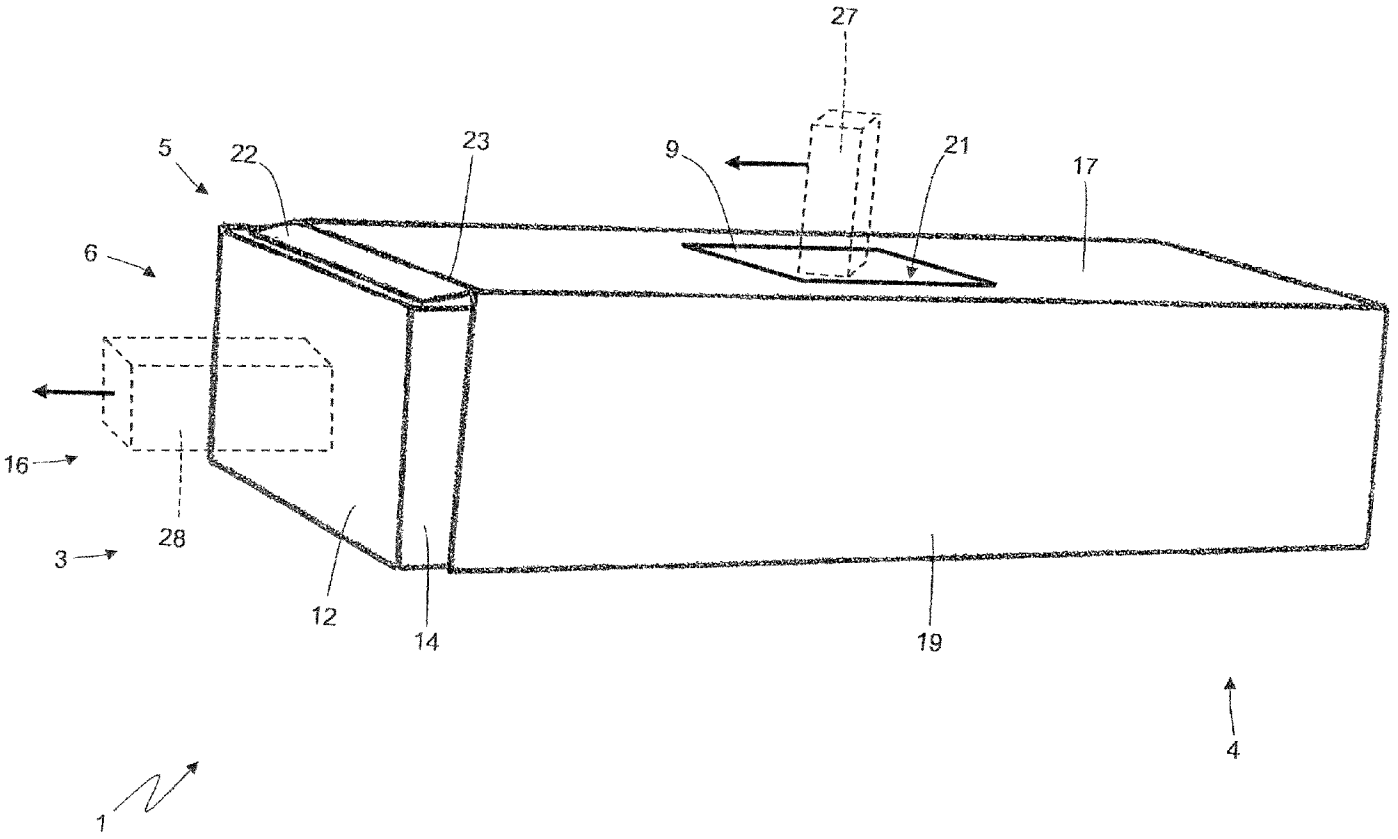

Once sealing flap 22 is folded about transverse fold line 23 to 'weaken' the packing material (as shown in FIG. 5), inner container 3 is slid partly out of outer container 4 (as shown in FIG. 6), so that sealing flap 22, formerly folded onto top wall 12 of lid 6 of inner container 3, returns substantially to its original position coplanar with front wall 17 of outer container 4. A front edge of top wall 12 of lid 6 of inner container 3 is preferably distanced from the top edge of front wall 17 of outer container 4 by a distance no smaller than the longitudinal dimension of sealing flap 22. More specifically, a front edge of top wall 12 of lid 6 of inner container 3 is preferably distanced from the top edge of front wall 17 of outer container 4 by a distance just slightly greater than the longitudinal dimension of sealing flap 22.

In one embodiment in FIG. 6, to extract inner container 3 partly from outer container 4, outer container 4 is clamped (i.e. prevented from moving), and thrust is exerted on inner container 3 by an actuator 27, with engages front wall 9 of inner container 3 through opening 21 in front wall 17 of outer container 4. More specifically, actuator 27 is moved vertically (i.e. perpendicularly to front wall 9 of inner container 3) through opening 21 onto front wall 9 of inner container 3, and is then moved horizontally (i.e. parallel to front wall 9 of inner container 3) to push inner container 3 out of outer container 4. Sufficiently firm contact between the base of actuator 27 and front wall 9 of inner container 3 may be ensured by mechanical friction (in which case, the base of actuator 27 is 'rough' to increase the friction coefficient, and actuator 27 is pressed with a given force onto front wall 9 of inner container 3). Alternatively, sufficiently firm contact between the base of actuator 27 and front wall 9 of inner container 3 may be ensured by providing actuator 27 with a suction head, in which suction is activated when the suction head contacts front wall 9 of inner container 3.

In a different embodiment in FIG. 6, to extract inner container 3 partly from outer container 4, outer container 4 is clamped (i.e. prevented from moving), and pull is exerted on inner container 3 by an actuator 28, which engages top wall 12 of lid 6 of inner container 3 and is fitted with a suction head. In actual use, the suction head of actuator 28 is moved horizontally (i.e. perpendicularly to top wall 12) into contact with top wall 12 of lid 6 of inner container 3, suction through the suction head is activated, and actuator 28 is then moved horizontally (i.e. perpendicularly to top wall 12) to pull inner container 3 out of outer container 4.

It is important to note that, to extract inner container 3 from outer container 4, actuators 27 and 28 may be used either jointly, to exert combined force, or singly (i.e. either actuator 27 or actuator 28).

Figure 7:
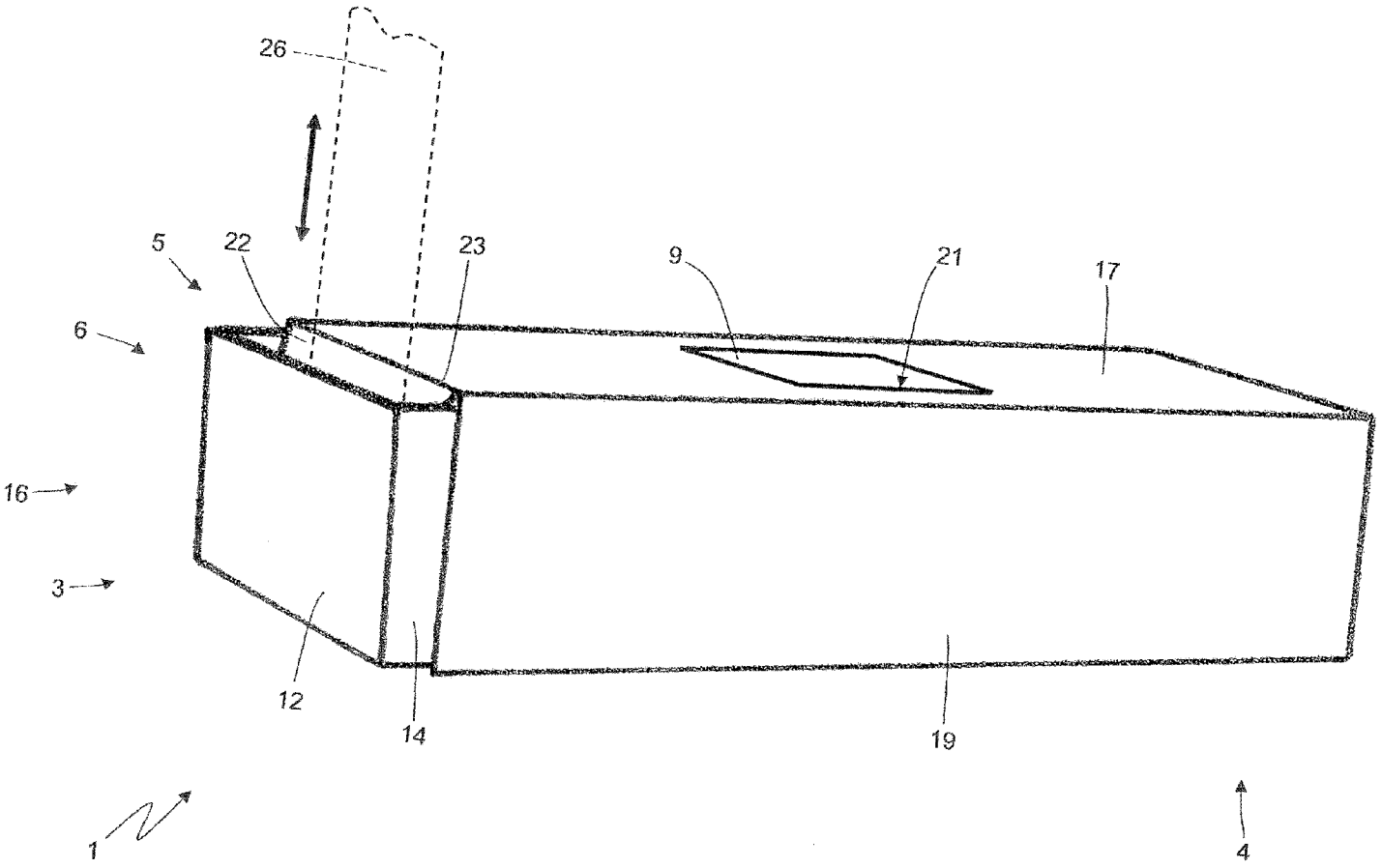

Once inner container 3 is extracted partly from outer container 4 (as shown in FIG. 6), folding device 26 folds sealing flap 22 ninety degrees about transverse fold line 23 towards open top end 5 of inner container 3 and into the work position beneath top wall 12 of lid 6 of inner container 3 (as shown in FIG. 7). This folding operation of sealing flap 22 is performed by a linear forward and reverse movement (perpendicular to front wall 17 of outer container 4) of folding device 26 (the same folding device 26 which first folded sealing flap 22 to 'weaken' the packing material). In a different embodiment (not shown), folding device 26 rotates as described above.

Inner container 3 is slid out of outer container 4 by an amount corresponding to said distance between the front edge of top wall 12 of lid 6 and the top edge of front wall 17 of outer container 4, which has a maximum effective limit, i.e. if said distance is slightly more than the longitudinal dimension of sealing flap 22, wrapped group 2 of cigarettes would project from open end 16 of outer container 4, thus preventing sealing flap 22 from being folded 90° beneath top wall 12 of lid 6 of inner container 3.

Figure 8:
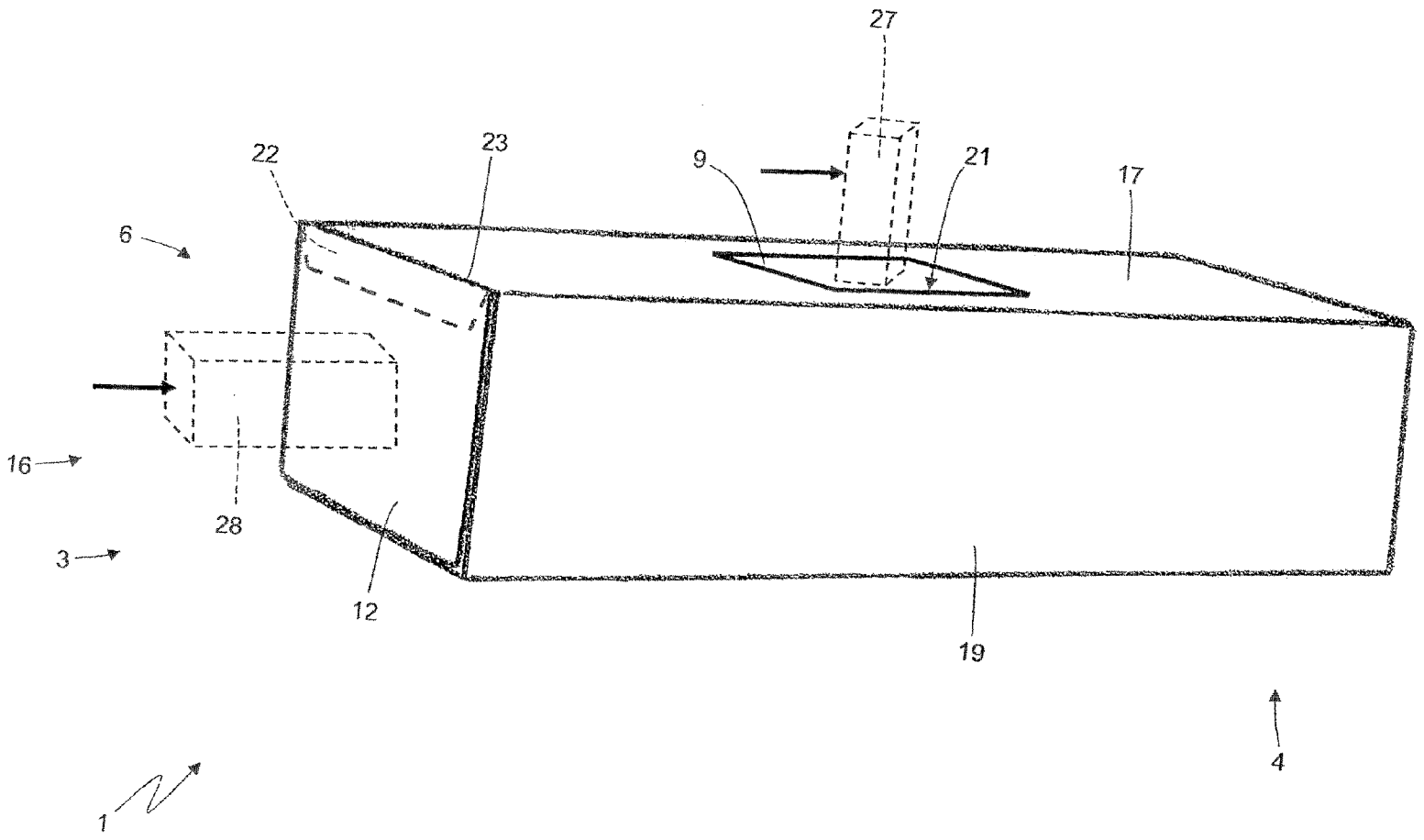

Finally, as shown in FIG. 8, inner container 3 is reinserted fully inside outer container 4 to complete packet 1 of cigarettes as shown in FIGS. 1, 2 and 3.

In one embodiment, to insert inner container 3 fully inside outer container 4, outer container 4 is clamped (i.e. prevented from moving), and thrust is exerted on inner container 3 by actuator 27, which engages front wall 9 of inner container 3 through opening 21 in corresponding front wall 17 of outer container 4 (and operates as described previously).

In a different embodiment, to insert inner container 3 fully inside outer container 4, outer container 4 is clamped (i.e. prevented from moving), and thrust is exerted on inner container 3 by actuator 28, which engages top wall 12 of lid 6 of inner container 3 (and operates as described previously).

It is important to note that, to insert inner container 3 inside outer container 4, actuators 27 and 28 may be used either jointly, to exert combined force, or singly (i.e. either actuator 27 or actuator 28).

The packing method described has the advantage of producing packet 1 of cigarettes easily and efficiently. This is achieved by virtue of blanks 24 and 25 being folded in exactly the same way as for a packet 1 of cigarettes with no sealing flap 22 (which is left untouched, i.e. completely disregarded, when folding blanks 24 and 25), and by sealing flap 22 only being folded independently after blanks 24 and 25 are fully folded.

The invention claimed is:

1. A packing method for producing a package (1) of tobacco articles comprising the steps of:

providing an inner container (3), which houses a wrapped group (2) of tobacco articles, has an open top end (5), and comprises a lid (6) hinged to the inner container (3) along a hinge (7) to close the open top end (5);

providing an outer container (4) housing the inner container (3) so as to allow the inner container (3) to slide with respect to the outer container (4) between a closed configuration, in which the inner container (3) is inserted inside the outer container (4), and an open configuration, in which the inner container (3) is extracted partly from the outer container (4); and providing a sealing flap (22), which is hinged along a transverse fold line (23) to a top edge of a front wall (17) of the outer container (4), and is movable between a work position, in which the sealing flap (22) is perpendicular to the front wall (17) of the outer container (4) and located beneath a top wall (12) of the lid (6) of the inner container (3), and a rest position, in which the sealing flap (22) is substantially parallel to the front wall (17) of the outer container (4);

folding a first blank (24) about the wrapped group (2) of tobacco articles to form the inner container (3);

folding a second blank (25) about the inner container (3) to form the outer container (4)

folding the second blank (25), except for the sealing flap (22), about the inner container (3), so as to leave the sealing flap (22) in an initial position substantially coplanar with the front wall (17) of the outer container (4);

extracting the inner container (3) partly from the outer container (4) by sliding the inner container (3) with respect to the outer container (4);

folding the sealing flap (22) 90° about the transverse fold line (23) towards the open top end (5) of the inner container (3) and into the work position beneath the top wall (12) of the lid (6) of the inner container (3); and inserting the inner container (3) fully inside the outer container (4) by sliding the inner container (3) with respect to the outer container (4).

2. A packing method as claimed in claim 1, wherein the step of extracting the inner container (3) partly from the outer container (4) comprises distancing a front edge of the top wall (12) of the lid (6) of the inner container (3) from the top edge of the front wall (17) of the outer container (4) by a distance greater than or equal to the longitudinal dimension of the sealing flap (22).

3. A packing method as claimed in claim 1, comprising folding the sealing flap (22) about the transverse fold line (23), prior to extracting the inner container (3) partly from the outer container (4).

4. A packing method as claimed in claim 3, comprising folding the sealing flap (22) 90° about the transverse fold line (23) and onto the top wall (12) of the lid (6) of the inner container (3), prior to extracting the inner container (3) partly from the outer container (4).

5. A packing method as claimed in claim 3, comprising folding the sealing flap (22) about the transverse fold line (23) and towards the front wall (17) of the outer container (4), prior to extracting the inner container (3) partly from the outer container (4).

6. A packing method as claimed in claim 1, wherein the step of extracting the inner container (3) partly from the outer container (4) comprises the steps of:

clamping the outer container (4); and exerting thrust on the inner container (3) by means of a first actuator (27), which engages a wall (9) of the inner container (3) through an opening (21) formed through a corresponding front wall (17) of the outer container (4).

7. A packing method as claimed in claim 6, wherein the first actuator (27) has a suction head, which is brought into contact with the wall (9) of the inner container (3).

8. A packing method as claimed in claim 1, wherein the step of extracting the inner container (3) partly from the outer container (4) comprises the steps of: clamping the outer container (4); and exerting pull on the inner container (3) by means of a second actuator (28), which engages the top wall (12) of the lid (6) of the inner container (3), and has a suction head.

9. A packing method as claimed in claim 1, wherein the step of inserting the inner container (3) fully inside the outer container (4) comprises the steps of:

clamping the outer container (4); and exerting thrust on the inner container (3) by means of a first actuator (27), which engages a wall (9) of the inner container (3) through the opening (21) formed through the corresponding front wall (17) of the outer container (4).

10. A packing method as claimed in claim 1, wherein the step of inserting the inner container (3) fully inside the outer container (4) comprises the steps of:

clamping the outer container (4); and exerting thrust on the inner container (3) by means of a second actuator (28), which engages the top wall (12) of the lid (6) of the inner container (3).

* * * * *